US008515107B2

(12) United States Patent
Hain et al.

(10) Patent No.: US 8,515,107 B2
(45) Date of Patent: Aug. 20, 2013

(54) METHOD FOR SIGNAL PROCESSING IN A HEARING AID

(75) Inventors: Jens Hain, Kleinsendelbach (DE); Henning Puder, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 951 days.

(21) Appl. No.: 12/218,710

(22) Filed: Jul. 17, 2008

(65) Prior Publication Data

US 2009/0022344 A1 Jan. 22, 2009

(30) Foreign Application Priority Data

Jul. 20, 2007 (DE) ..... 10 2007 033 877

(51) Int. Cl.
*H04R 25/00* (2006.01)

(52) U.S. Cl.
USPC ..... 381/312; 381/94.1

(58) Field of Classification Search
USPC ..... 381/94.1
See application file for complete search history.

(56) References Cited

U.S. PATENT DOCUMENTS

| | | | | |
|---|---|---|---|---|
| 6,704,369 | B1 * | 3/2004 | Kawasaki et al. | 375/285 |
| 7,043,030 | B1 * | 5/2006 | Furuta | 381/94.1 |
| 7,257,231 | B1 * | 8/2007 | Avendano et al. | 381/99 |
| 2006/0120535 | A1 | 6/2006 | Puder | |

FOREIGN PATENT DOCUMENTS

| | | | |
|---|---|---|---|
| DE | 10029388 | A1 | 3/2001 |
| EP | 1655998 | A2 | 5/2006 |
| WO | WO 00/25489 | A1 | 5/2000 |

* cited by examiner

*Primary Examiner* — David Vu
*Assistant Examiner* — Jonathan Han

(57) ABSTRACT

Processing two input signals in a hearing aid with a first source separation and a second source separation is provided. A comparison of a first correlation with a second correlation and with a change in the first coefficient set as a function of a second coefficient set when the second correlation is smaller than the first correlation, with the second coefficient set being changed as a function of the first coefficient set when the second source separation is reset.

20 Claims, 9 Drawing Sheets

METHOD FOR SIGNAL PROCESSING IN A HEARING AID

CROSS REFERENCE TO RELATED APPLICATIONS

This application claims priority of German application No. 10 2007 033 877.7 DE filed Jul. 20, 2007, which is incorporated by reference herein in its entirety.

FIELD OF INVENTION

The invention relates to a method for processing input signals in a hearing aid and to an apparatus of a hearing aid for processing input signals.

BACKGROUND OF INVENTION

The enormous advance in microelectronics nowadays allows extensive analog and digital signal processing, even in the most confined spaces. Over the last few years, the availability of analog and digital signal processors with minimal spatial dimensions has also smoothed the way for their use in hearing aids, obviously a field of application in which the system size is subjected to a significant restriction.

SUMMARY OF INVENTION

In the case of hearing aids, a simple amplification of an input signal from a microphone often leads to an unsatisfactory result, since interference signals can be amplified at the same time and the benefits for the user can be restricted to special acoustic situations. Digital signal processors which digitally process the signal of one or several microphones in order thus to suppress interference noises in a targeted fashion for instance have therefore already been integrated into hearing aids for a few years.

Modern signal processing methods may include inter alia a so-called blind source separation (Blind Source Separation, or BSS for short), with several acoustic sources being broken down into individual signals. To this end, two or several microphones can record the acoustic environment and provide corresponding input signals for further processing. A classification of the input signal and/or of the input signals is also known, with a placement of the actual acoustic situation taking place on the basis of classification variables, like for instance of the input signal level or the number of detected acoustic sources. The source separation can then be adjusted according to the determined signal situation in order to provide the user of the hearing aid with an optimum output signal.

Methods for blind source separation, also known in brief as source separation, can include here a filtering of two input signals for generating two output signals and the determination of a so-called cross correlation, also known in brief as correlation, of the two output signals. The filters are adjusted until the correlation reaches a minimum, which then corresponds to a maximum separation of the output signals. The filtering generally takes place with the aid of a coefficient set, which includes at least one coefficient. A coefficient set, for instance in the form of a scalar, vector or matrix, is then used to filter the corresponding input signal.

In certain signal situations, a source separation can however achieve a local minimum of the correlation, although an absolute minimum exists. The source separation then erroneously results in a maximum separation already taking place and omits a significant change in the coefficient set. In such a case, this is also referred to as freezing the source separation. A frozen source separation is not able to change the coefficient set further although the correlation has still not reached an absolute minimum and the source separation thus does not take place completely.

In order to identify such a disadvantageous freezing, an additional source separation can take place for instance, for example a second source separation or a so-called shadow source separation, which is continuously reset in order to avoid freezing this additional source separation. If such an additional source separation determines a smaller correlation than the main source separation, for instance a first source separation, which is not regularly continuously reset, this can be an indication of the main source separation being frozen in a local minimum.

In such an instance, the coefficient set of the main source separation can be replaced at least partially by the coefficient set of the second source separation. The disadvantage here is that since its last reset and/or initialization until reaching a smaller correlation than the main source separation, the additional source separation has only minimally adapted the corresponding coefficient set. Since this inadequately adapted coefficient set then determines the coefficient set of the main source separation, the main source separation can deliver unsatisfactory results here.

DE 10029388 A1 discloses a signal separation apparatus, in which a first and a second signal of the signal sources originate from two systems, which are transmitted to a receiving device provided with two receiving facilities. The first and the second signal mutually superimpose one another as a result of crosstalk during their transmission through a transmission channel section. The two signals are received by the two input facilities of the receiving device. The signal separation apparatus has a signal separation section and an evaluation function calculation section. The signal separation section has six filter facilities with variable branching coefficients. The evaluation function calculation section has a first and a second autocorrelation calculation facility and a minimum value determination facility for determining a minimum value.

EP 1655998 A2 discloses a method for generating stereo signals for separated sources and a corresponding acoustics system. Here a blind source separation is carried out by at least two microphone signals for obtaining transmission functions of filters of a first filter facility. Transmission functions of filters of a second filter facility are also determined with the aid of the transmission function of the filter of the first filter facility. The two microphone signals are filtered in each instance using at least two filters of the second filter facility.

WO 00/25489 A1 discloses a method and an arrangement, which enables the separation of superimposed acoustic signals, which are statistically independent of each other, with a reduced computing outlay. Here parameters of a technical system are determined such that the statistical independence of the output signals is maximized. The parameters are elements of a separation matrix, with which the quantity of superimposed input signals is multiplied or also folded, as a result of which the output signals are formed. With the optimization of the parameters of the separation matrix, the following steps are implemented:

Repeating a time-delayed decorrelation calculation for determining the intrinsic values of the separation matrix;

Determining the intrinsic values of the separation matrix for which the correlations assume a minimum value;

Implementing a cumulant minimization, with the intrinsic values determined in the previous step being used as start values for the cumulant minimization. A linear filtering can result in a Gauss distribution with distortion of the data, in which the cumulants of a higher order move toward 0. This can thus result in marginal solutions, in which the cost function reaches a local minimum, with the desired actual separation (global minimum) not taking place. To avoid this unwanted situation, the structure of the separation transfer function is subjected to some restrictions.

It is thus the object of the present invention to provide an improved method for processing input signals in a hearing aid, as well as an improved apparatus for processing input signals in a hearing aid.

This object is achieved by the method and by the apparatus as claimed in the independent claims.

Additional advantageous embodiments of the invention are specified in the dependent claims.

According to one first aspect of the present invention, provision is made for a method for processing two input signals in a hearing aid, with the input signals being dependent on an acoustic signal, which includes the following steps: a first source separation, with two first output signals and a first correlation of the two first output signals being continuously determined from the two input signals with a first coefficient set and with the first coefficient set being continuously determined as a function of the first correlation; a second source separation, with two second output signals and a second correlation of the two second output signals being continuously determined from the two input signals with a second coefficient set, and with the second coefficient set being continuously determined as a function of the second correlation; a comparison of the first correlation with the second correlation and a change in the first coefficient set as a function of the second coefficient set, if the second correlation is smaller than the first correlation, with the method also including changing the second coefficient set as a function of the first coefficient set when resetting the second source separation.

According to a second aspect of the present invention, provision is made for an apparatus for processing two input signals which are dependent on an acoustic signal in a hearing aid, with the apparatus having a processing unit, which continuously determines two first output signals and a first correlation of the two first output signals from the two input signals with a first coefficient set and continuously determines the first coefficient set as a function of the first correlation and continuously determines two second output signals and a second correlation of the two second output signals from the two input signals with a second coefficient set and continuously determines the second coefficient set as a function of the second correlation, with the processing unit changing the first coefficient set as a function of the second coefficient set, if the second correlation is smaller than the first correlation and with the processing unit resetting the second coefficient set as a function of the first coefficient set.

The method according to the invention and the apparatus according to the invention are advantageous in that the second source separation can start with a reset with a coefficient set, which is dependent on the first coefficient set of the first source separation. Here the second source separation can revert back to a coefficient set after a reset, which can advantageously already include an adaptation. This adaptation can be contained in the first coefficient set by means of the first source separation. The second source separation can thus omit part of an adaptation, which was already accounted for in the corresponding first coefficient set and can advantageously achieve a corresponding adaptation more rapidly.

If in the case of a freezing the first coefficient set of the first source separation is changed as a function of the second coefficient set of the second source separation, the first coefficient set can have an already significantly increased adaptation and can thus result significantly more rapidly in a satisfactory result for the user of the hearing aid.

According to one embodiment of the present invention, the method includes storing the first coefficient set. This storage can take place as a function of a temporal change in the first correlation. The first coefficient set can also be stored, if the first correlation within a first period of time is still only marginal, with it being possible for the first period of time to lie within a range of 1 second to 10 seconds. A marginal variation in the first correlation can be provided if the correlation does not vary by a value of more than 30%, more than 10% or more than 5%.

Accordingly, an advantageous first coefficient set can be stored and is then available at the time of resetting the second source separation in order to change the second coefficient set accordingly as a function of the stored first coefficient set. Advantageous first coefficient sets can thus be stored again if the first correlation changes temporally minimally. A minimal temporal change in the first correlation can be an indication that the first source separation provides a satisfactory result and performs an optimum source separation which corresponds to the respective acoustic signal situation.

According to a further embodiment of the present invention, the storage of the first coefficient set can take place in a storage unit of a group of storage units, with the selection of the storage unit taking place as a function of a signal situation. Various first coefficient sets can thus be stored for several signal situations.

According to a further embodiment of the present invention, at least two first coefficient sets for a signal situation are stored in the storage units of the storage unit group. At least two predetermined coefficient sets can thus be recalled from the storage units as a function of the signal situation and the first coefficient set is changed as a function of the predetermined coefficient sets. That predetermined coefficient set, for which a change in the first coefficient set produces a minimum first correlation, is also determined. Several coefficient sets are thus advantageously available for a signal situation, from which coefficient sets that coefficient can be selected, for instance by a comparison of the respectively resulting correlation, which produces a minimum correlation and thus an optimum separation efficiency.

According to a further embodiment of the present invention, the second source separation is reset after a second period of time has elapsed. The second source separation can herewith be periodically reset and a potentially occurring, disadvantageous freezing of the second source separation can be prevented. Examples of a second period of time are periods of times in a range of 10 milliseconds to 10 seconds.

According to a further embodiment of the present invention, the second source separation is reset once a second period of time has elapsed. At least two first coefficient sets for a signal situation are also stored in the storage units of the storage unit group. At least two predetermined coefficient sets can thus be recalled from the storage units as a function of the signal situation and the second coefficient set is changed during the reset process as a function of the recalled coefficient sets. That recalled coefficient set, for which a change in the second coefficient set produces a minimum second correlation, is also determined. Several coefficient sets are thus advantageously available for a signal situation, from which that coefficient set can be selected, for instance by a comparison of the respectively resulting correlation, which produces a minimum correlation and thus optimum separation efficiency.

According to a further embodiment of the present invention, the second source separation is reset after a second period of time has elapsed and the second coefficient set is changed during the reset process as a function of a predetermined coefficient set. Here the predetermined coefficient set is recalled from a storage unit of the group of storage units as a function of a signal situation. The second source separation can thus advantageously also be reset according to the signal situation. In this way the second source separation can thus revert back to an output coefficient set which optimally corresponds to the actual signal situation after the reset process.

According to a further embodiment of the present invention, at least one of the following classification variables is determined: a level of an input signal, a level of an output signal, a distribution of the level, a performance spectrum or a spatial position of a source of one of the input signals. The signal situation can then be determined according to at least one of these classification variables.

According to a further embodiment of the present invention, the method includes a third source separation, with two third output signals and a third correlation of the two third output signals being continuously determined from the two input signals with a third coefficient set, with the third coefficient set being continuously determined as a function of the third correlation, with a comparison of the first correlation with the third correlation taking place and with the first coefficient set being changed if the third correlation is smaller than the first correlation.

A method according to this embodiment of the present invention can advantageously also capture a possible freezing of the second source separation. As the third source separation can be reset with a universal output coefficient set, this provides a third correlation which is independent of the signal situation and the already adapted coefficient sets. The third source separation is thus not prone to freezing, which can in some circumstances arise in special combinations with the first and second coefficient set and/or a corresponding situation. In such an instance, the first source separation can then be advantageously reset and the first coefficient set can be set as a function of the third coefficient set.

BRIEF DESCRIPTION OF THE DRAWINGS

Preferred embodiments of the present invention are described in more detail below with reference to the appended drawings, in which.

DETAILED DESCRIPTION OF INVENTION

Figure 1A:
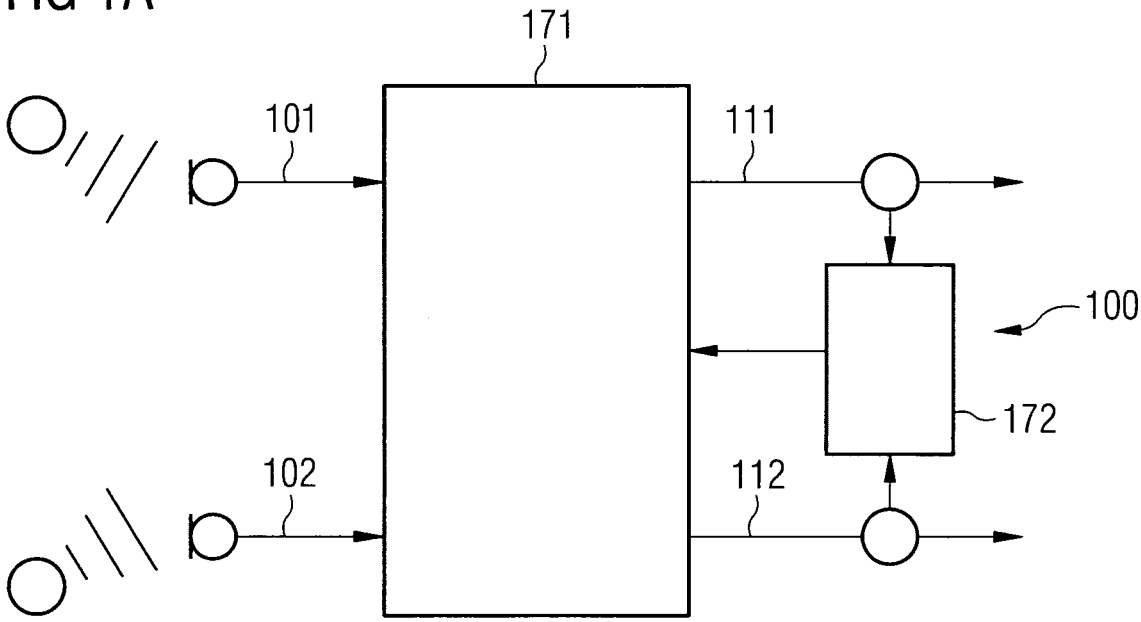
FIG. 1A shows a schematic representation of a source separation.

FIG. 1A shows a schematic representation of a source separation 100. Here one or several acoustic sources transmit acoustic signals. These acoustic signals are received by microphones, which provide a first input signal 101 and a second input signal 102. A first filter module 171 receives the first input signal 101 and the second input signal 102, in order to provide a first output signal 111 and an additional first output signal 112.

A correlation module 172 determines a first correlation of the two first output signals 111, 112 from the first output signal 101 and from the additional first output signal 112. The result of the correlation module 172 is fed back to the filter module 171, so that the filter module 171 correspondingly modifies internal filters, for instance in the form of a coefficient set, in order to achieve a minimization of the first correlation of the two first output signals 111, 112. If the source separation 100 has achieved an absolute minimum of the correlation, the output signals 101, 112 have a minimum correlation and are thus maximally separated.

Figure 1B:
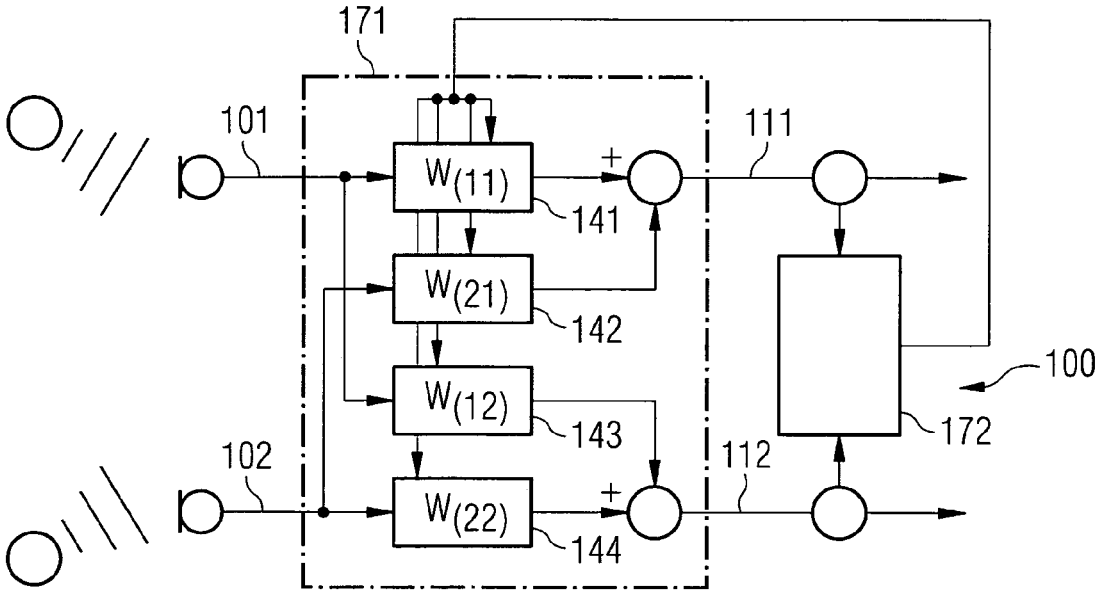
FIG. 1B shows a further schematic representation of a source separation.

FIG. 1B shows a further schematic representation of the source separation 100 taking into account the details. Acoustic sources generate acoustic signals, which are received by microphones and are provided to the filter module 171 in the form of the first input signal 101 and the second input signal 102. Here the filter module 171 has a first filter 141, a second filter 142, a third filter 143 and a fourth filter 144. The first input signal 101 is provided here to the first filter 101 and the third filter 143. The second input signal 102 is also provided to the second filter 142 and to the fourth filter 144. The filters 141, 142, 143, 144 can be characterized on the basis of filter coefficients, or a filter coefficient set, like for instance the filter coefficient $w_{ij}$.

If the first input signal 101 has passed through the first filter 141 and the second input signal 102 has passed through the second filter 142, these signals are added to the first output signal 111. Similarly here, the additional first output signal 102 is provided by adding the first input signal 101, which has passed through the third filter 143 and by adding the second input signal 102, which has passed through the fourth filter 144. The correlation module 172 determines the correlation of the two first output signals 111, 112, and correspondingly controls the filters 141, 142, 143, 144, thus striving for a corresponding minimum of the correlation.

Figure 2:
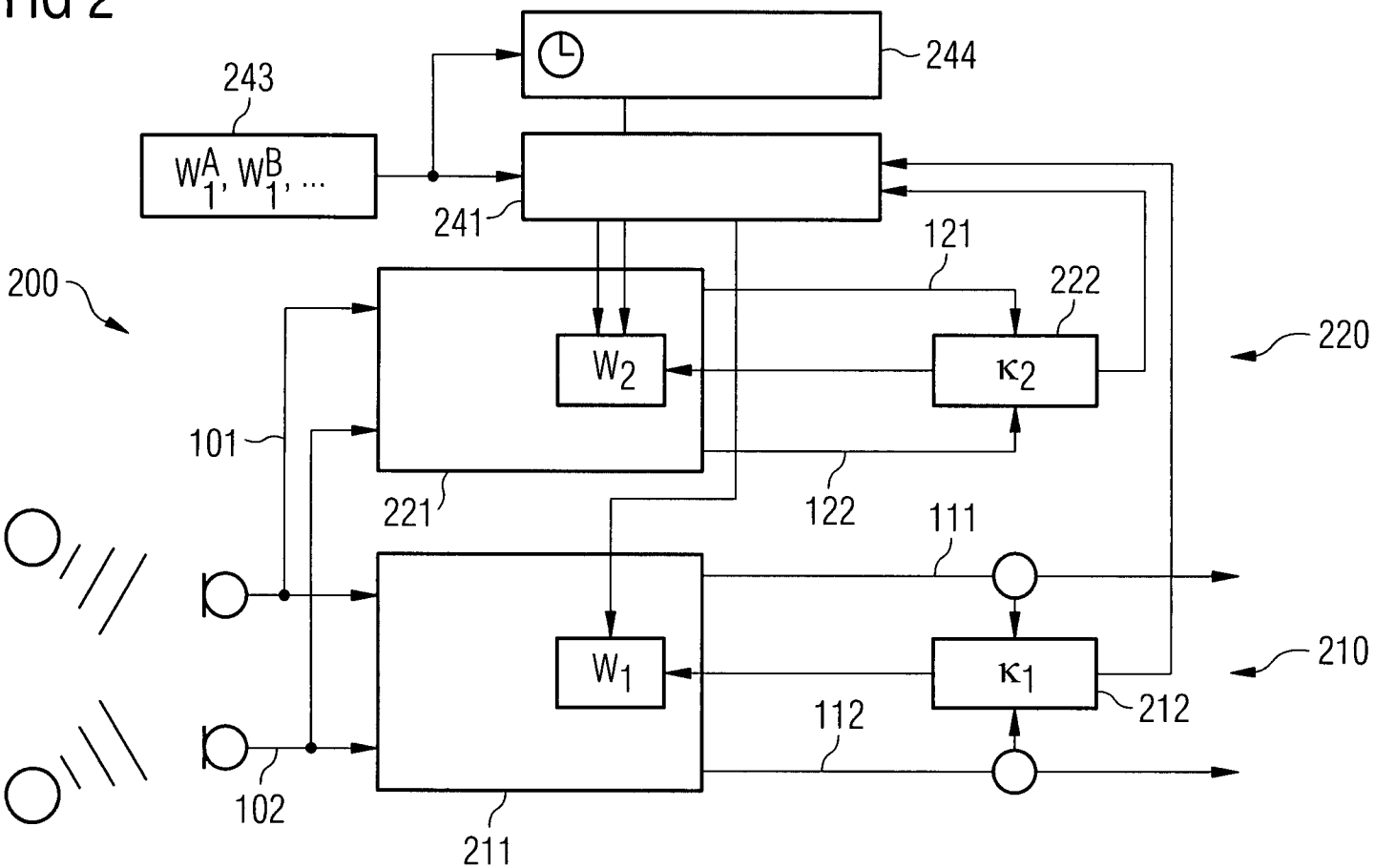
FIG. 2 shows a first and second source separation according to a first embodiment of the present invention.

FIG. 2 shows a schematic representation of a first source separation in conjunction with a second source separation according to a first embodiment of the present invention. Sound sources generate acoustic signals, which are received by microphones. Here two microphones provide the first input signal 101 and the second input signal 102 both to a first source separation 210 and also to a second source separation 220.

The first source separation 210 includes a filter module 211 and a correlation module 212. The filter module 211 generates a first output signal 111 as well as an additional first output signal 112 from the first input signal 101 and the second input signal 102 with the aid of a first coefficient set $W_1$. The correlation module 212 continuously determines a first correlation $\kappa_1$ from the two first output signals 111, 112, which is used to modify the first coefficient set $W_1$ such that the first correlation $\kappa_1$ is minimized and the two first output signals 111, 112 are thus maximally separated.

A second source separation 220 includes a filter module 221 and a correlation module 222. The filter module 221 generates a second output signal 121 as well as an additional second output signal 122 from the first input signal 101 and the second input signal 102 with the aid of a second coefficient set $W_2$. The correlation module 222 continuously determines a second correlation $\kappa_2$ from the two second output signals 121, 122, which is used to modify the second coefficient set $W_2$ such that the second correlation $\kappa_2$ is minimized and the two second output signals 121, 122 are thus maximally separated.

According to this embodiment of the present invention, a comparison module 241 compares the first correlation $\kappa_1$ with the second correlation $\kappa_2$. If the second correlation $\kappa_2$ is smaller than the first correlation $\kappa_1$, the comparison module 241 changes the second coefficient set $W_2$ as a function of the first coefficient set $W_1$.

To this end, the comparison module 241 can revert back to stored coefficient sets $W_1^A$, $W_1^B$, etc., which are stored in a storage unit group 243. The coefficient sets $W_1^A$, $W_1^B$, etc., which are stored in the storage unit group 243, can be in correspondingly different signal situations dependent on the first coefficient set $W_1$. Provision can thus be made to store an adapted coefficient set $W_1$ in a first signal situation "A" as a coefficient set $W_1^A$ in the storage unit group 243. Provision can also be made to store the first coefficient set $W_1$ in a second signal situation "B" as a coefficient set $W_1^B$ in the storage unit group 243 etc.

Provision can also be made for the comparison module 241 to also revert back to several stored coefficient sets $W_1^{A1}$, $W_1^{A2}$, . . . , $W_1^{B1}$, $W_1^{B2}$, . . . for a signal situation, which are stored in a storage unit group 243. The coefficient sets $W_1^{A1}$, $W_1^{A2}$, . . . , $W_1^{B1}$, $W_1^{B2}$, . . . can be stored again in the storage unit group 243, and are stored there for instance in the event of a change in the corresponding correlation which is still only marginal. Provision can thus be made for several adapted coefficient set $W_1$ in a first signal situation "A" to be stored as coefficient sets $W_1^{A1}$, $W_1^{A2}$, . . . in the storage unit group 243. Several coefficient sets $W_1$ are thus available for a signal situation, from which that coefficient set $W_1$, for which a minimum first correlation and thus an optimum separation efficiency results, can be selected.

Acoustic signal situations "A", "B", etc., known to the hearing aid, which are to imitate situations in daily life, can be assigned to an actual signal situation on the basis of corresponding classification variables for instance. To determine the actual signal situation of the most similarly known signal situation, a determined classification variable does not have to be identical to a classification variable of the known signal situations, but bandwidths and tolerances can instead be provided for the respective classification variables for instance. Examples of known acoustic signal situations "A", "B", etc., are indicated in the following table:

| Signal situation | Classification variables |
|---|---|
| Quiet speech | few signal components/sources<br>weaker signal components<br>few weak signal components<br>high signal/noise ratio |
| Speech in a vehicle | many signal components<br>(reflections)<br>components with a characteristic performance spectrum (e.g. engine). |
| Cocktail party | many signal components<br>high level |

Here the signal components can be the output signals, the input signals or can also be generated from an additional decomposition and/or separation of the input signals and/or output signals. An additional apparatus and/or additional method can be provided in the hearing aid in order to determine a signal component, a signal/noise ratio, a performance spectrum, a level, a number of signal components, an additional classification variable and/or the signal situation.

The comparison module 241 can also assign a corresponding signal situation and use one of the coefficient sets $W_1^A$, $W_1^B$ etc. stored in the storage unit group 243 etc., in order to change the first coefficient set $W_1$. To this end, the comparison module 241 can determine a corresponding signal situation, or receive the correspondingly determined signal situation from an additional module, a method or an additional apparatus. Provision can also be made for the differentiation to be omitted in different signal situations and for the storage unit group 243 only to store a coefficient set as a function of the first coefficient set $W_1$. In this instance, the storage unit group 243 can be replaced by an individual storage unit.

According to this embodiment of the present invention, a timer module 244 resets the second source separation 220 once a certain period of time has elapsed, for instance once a second period of time has elapsed, by the timer module 244 setting the second coefficient set $W_2$ as a function of a first coefficient set $W_1^A$, $W_1^B$, etc. To this end, the timer module 244, can select a first coefficient set $W_1$ from the storage unit group 243 according to the current signal situation, and can then reset the second source separation 220 by means of correspondingly setting the second coefficient set $W_2$. Here the timer module 244 can take over a complete coefficient set $W_1^A$, $W_1^B$, etc., in the second coefficient set $W_2$, or only a part thereof. For example, the storage depth of the storage unit group 243 can allow the storage of 1024 coefficients for each coefficient set $W_1^X$ (X=A, B, etc.), with only a part of the coefficients, for instance 512 coefficients, being taken over as coefficient set $W_2$ during the reset process.

Provision can also be made for the second coefficient set $W_2$ also to be changed for a signal situation also as a function of several stored coefficient sets $W_1^{A1}$, $W_1^{A2}$, . . . Several coefficient sets $W_1$ are thus available for a signal situation, from which that coefficient set $W_1$, for which a minimum second correlation and thus an optimum separation efficient result, can be selected.

According to this embodiment of the present invention, the second source separation 220 is as a result reset with an already adapted coefficient set and/or with a coefficient set adjusted to a current signal situation. Advantageously the second source separation 220 can thus already begin with an at least partially adapted coefficient set. As a result, the second source separation 220 can perform a source separation more quickly and the corresponding second correlation $\kappa_2$ can drop more quickly below the first correlation $\kappa_1$ in the event that the first source separation 210 freezes and the first source separation can be advantageously reset more rapidly, it can thus respond more rapidly to a disadvantageous freezing of the first source separation 210.

By resetting the second coefficient set $W_2$ as a function of one of the first coefficient sets $W_1^A$, $W_1^B$, etc. in the instance of the first source separation 210 of the first coefficient $W_1$ freezing as a function of the second coefficient set $W_2$, being at least partially reset, with it being possible at this time for the second coefficient set $W_2$ to advantageously comprise an already progressed adaptation. After determining and after correspondingly eliminating the freezing of the first source separation 210, the first source separation 210 can thus continue with an at least partially adapted first coefficient set $W_1$, and can thus provide a satisfactory output signal and result for the user of the hearing aid more rapidly.

Figure 3:
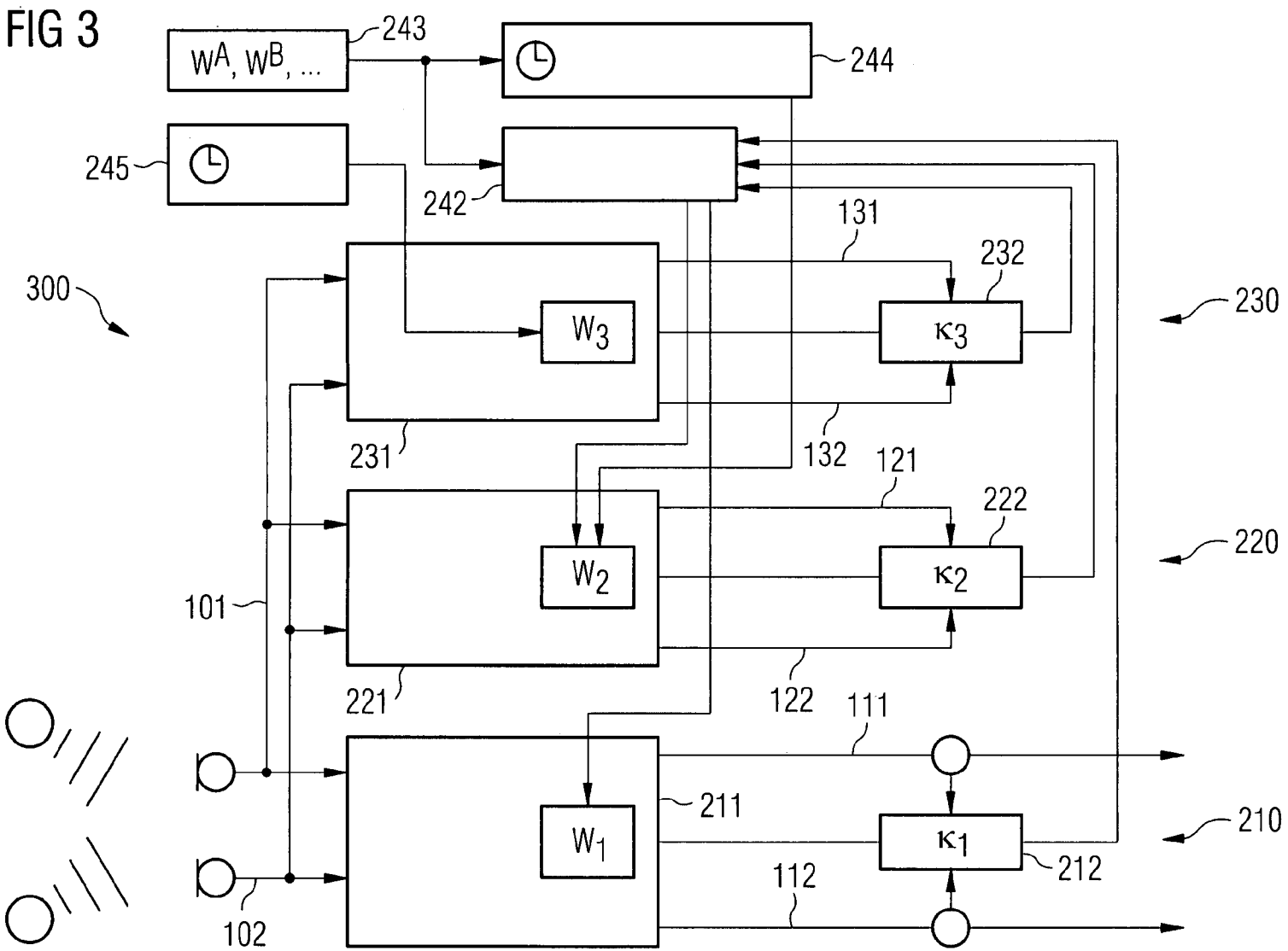
FIG. 3 shows a first, second and third source separation according to a second embodiment of the present invention.

FIG. 3 shows a first source separation, a second source separation and a third source separation according to a second embodiment of the present invention. The first source separation 210, the second source separation 220 as well as the first timer module 244 and the storage unit group 243 were already described in conjunction with FIG. 2 and are set out correspondingly in accordance with this second embodiment.

According to this second embodiment of the present invention, a third source separation 230 is also provided. Here the third source separation 230 includes a third filter module 231 as well as a third correlation module 232. The filter module 231 generates a third output signal 131 as well as an additional third output signal 132 from the first input signal 101 and the second input signal 102 with the aid of a third coefficient set $W_3$. The correlation module 232 continuously determines a third correlation $\kappa_3$ from the two third output signals 131, 132, which is used to modify the third coefficient set $W_3$ such that the third correlation $\kappa_3$ is minimized and the two third output signals 131, 132 are maximally separated. An additional timer module 245 is also provided which resets the third source separation 230 once a certain period of time, for instance a third period of time has elapsed, by the third source separation 230 setting the third coefficient set $W_3$ to an output coefficient set.

According to this embodiment of the present invention, the first correlation $\kappa_1$, the second correlation $\kappa_2$ and the third correlation $\kappa_3$ are fed to an additional comparison module 242, which compares the first correlation $\kappa_1$ with the second correlation $\kappa_2$. The additional comparison module 242 can also compare the first correlation $\kappa_1$ with the third correlation $\kappa_3$ and/or the second correlation $\kappa_2$ with the third correlation $\kappa_3$. If the second correlation $\kappa_2$ is smaller than the first correlation $\kappa_1$, the additional comparison module 242 changes the second coefficient set $W_2$ as a function of the first coefficient set $W_1$, as was already described in conjunction with FIG. 2. According to this embodiment, a potential freezing of the second source separation can however also be advantageously captured.

If the third correlation $\kappa_3$ is smaller than the first correlation $\kappa_1$ and/or the third correlation $\kappa_3$ is smaller than the second correlation $\kappa_2$, this can be an indication that the second source separation 220 is frozen. It is also possible that the first source separation 210 is frozen. As the third source separation 230 can be reset with a universal output coefficient set, this provides a third correlation $\kappa_3$, which is independent of the signal situation and the already adapted coefficient sets. In such an instance, the first source separation can then be advantageously reset and the first coefficient set is reset as a function of the third coefficient set. The same can also occur for the second source separation 220.

According to embodiments of the present invention, modules, like for instance the filter modules 211, 221, 231, the correlation modules 212, 222, 232, the comparison modules 241, 242, and/or the timer modules 244, 245 can be embodied both as discretely embodied circuits as well as processes, for instance as a thread or task, running in a microprocessor, in a signal processor, or in an integrated process module.

Figure 4:
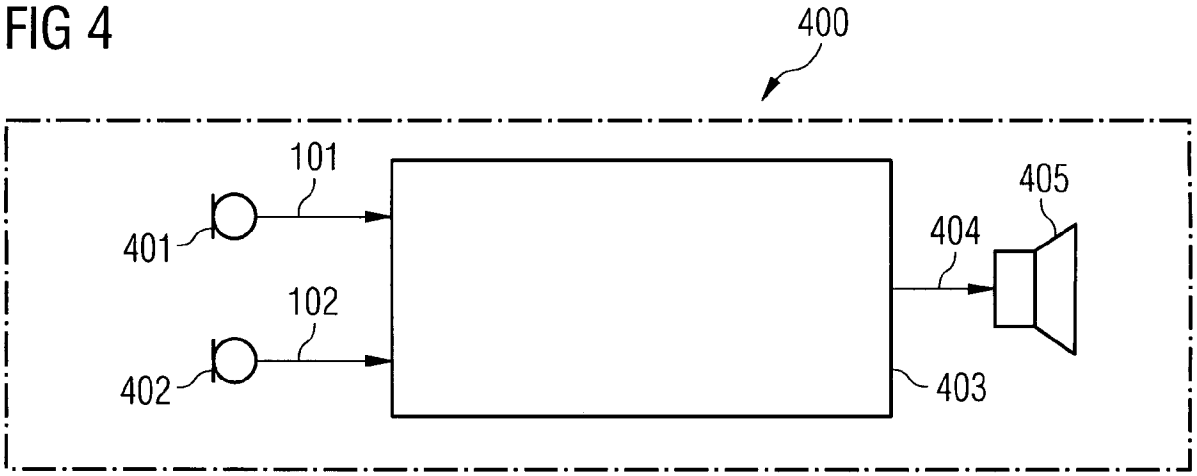
FIG. 4 shows a hearing aid according to a third embodiment of the present invention.

FIG. 4 shows a hearing aid according to a third embodiment of the present invention. Here the hearing aid 400 has a first microphone 401 and a second microphone 402. The first microphone 401 provides the first input signal 101 to a processing unit 403. The second microphone 402 provides the second input signal 102 to the processing unit 403. The processing unit 403 processes the first input signal 101 and the second input signal 102, in order to provide an output signal 404 to a loudspeaker 405 for outputting purposes. Here the processing unit 403 can include at least two source separations, a comparison module, a timer module and a storage unit group, like was described in conjunction with the first and second embodiment of the present invention. The hearing aid 400 can be integrated in a hearing device, which the user wears in the auditory canal for instance, behind the ear or also embodied in an external unit as a portable device. Here a spatial distance between the two microphones amounts to at least a minimum distance, which ensures a reliable source separation. In particular, the two microphones 401, 402 are arranged at a distance of up to approx. 20 mm, to approx. 10 mm, to approx. 4 mm or to approx. 2 mm in the hearing aid 400.

Figure 5:
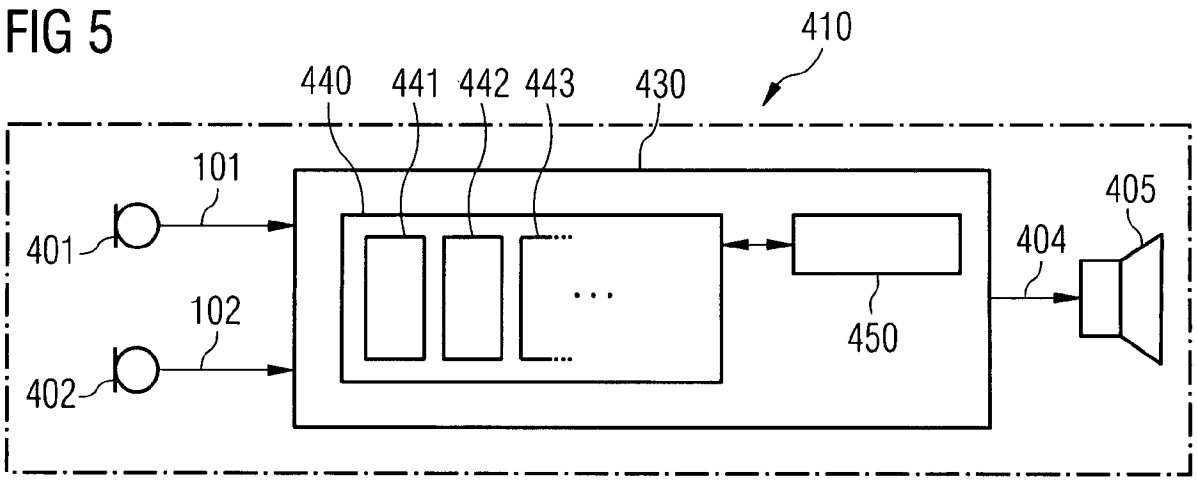
FIG. 5 shows a further hearing aid according to a fourth embodiment of the present invention and FIGS. 6A to 6D show schematic representations of flow charts of parts of a method according to a fifth, sixth, seventh and eighth embodiment of the present invention.

FIG. 5 shows a further hearing aid 410 according to a fourth embodiment of the present invention. Here the additional hearing aid 410 has the microphones 401 and 402, with the first microphone 401 providing the first input signal 101 and the second microphone 402 providing the second input signal 102 to an additional processing unit 430. The additional processing unit 430 processes the first input signal 101 and the second input signal 102 in order to provide the output signal 404 to the loudspeaker 405 for outputting purposes.

According to this embodiment of the present invention, the additional processing unit 430 has a process unit 440, which includes processes or modules, like for instance a first module 441, a second module 442, a third module 443 etc. The modules 441, 442, 443 can include for instance a source separation, a comparison module, a timer module, a filter module and/or a correlation module, like was illustrated in conjunction with the embodiments of the present invention described in FIGS. 2 to 4. The additional processing unit 430 also has a storage unit group 450, which the process unit 440 can access, in order for instance to store and recall at least one coefficient set, like was described in conjunction with FIGS. 2 and 3 for instance.

Figure 6A:
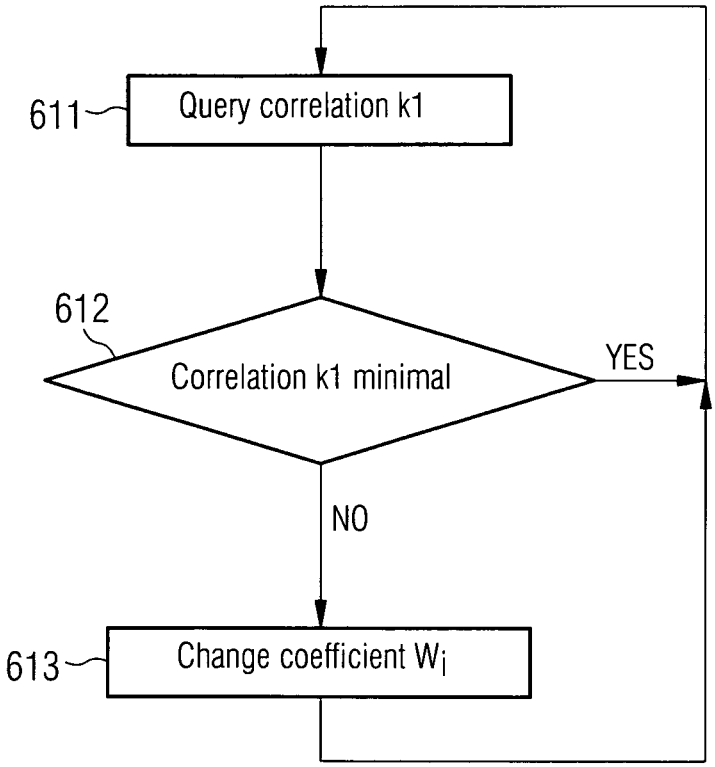

FIG. 6A shows a flow chart of a first module according to a fifth embodiment of the present invention. A correlation $\kappa_i$ is firstly queried in a first step 611. The correlation $\kappa_i$ can correspond here to the first correlation $\kappa_1$, the second correlation $\kappa_2$ and/or the third correlation $\kappa_3$, like was described in conjunction with the preceding figures and embodiments. In a bifurcation 612, it is determined whether the correlation $\kappa_i$ is minimal. To this end, preceding values of correlation $\kappa_i$ can be used for comparison purposes. In instances in which the correlation $\kappa_i$ is already minimal, the loop is continued with step 611 in order to detect a changing correlation $\kappa_i$. For instance, the correlation $\kappa_i$, can increase again by means of a corresponding change in the signal situation and/or the input signals and can thus reach a minimum.

If in the bifurcation 612 it is determined that the correlation $\kappa_i$ is not minimal, the coefficient set $W_i$ is changed in a step 613. The coefficient set $W_i$ can correspond here to the first coefficient set $W_1$, the second coefficient set $W_2$ or the third coefficient set $W_3$, like was described in conjunction with FIGS. 2 and 3. The change in the coefficient set C changes the filtering of the input signals and can thus effect a change in the output signals and/or correlation $\kappa_i$. After correspondingly modifying the coefficient $W_i$, the loop is continued with step 611. The process, the method or the module according to this embodiment corresponds to a source separation by minimizing a correlation.

Figure 6B:
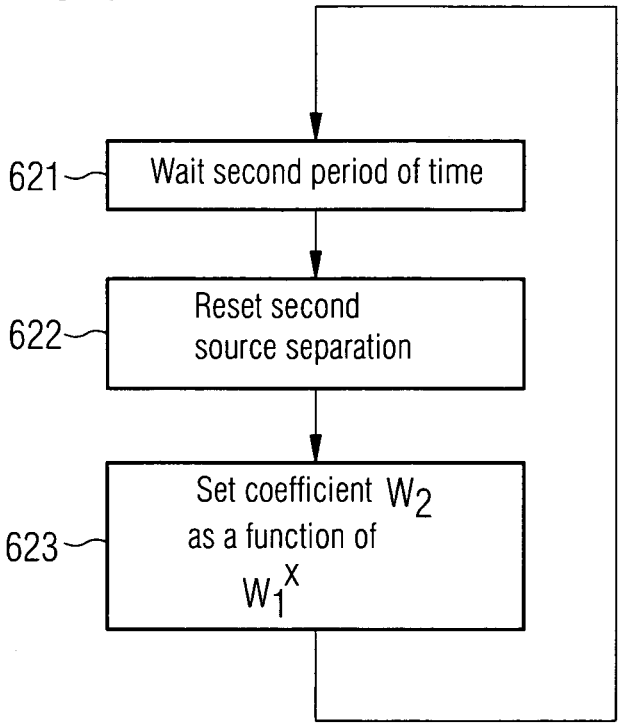

FIG. 6B shows a module according to a sixth embodiment of the present invention. A period of time, like for instance the second period of time, is firstly awaited in a first step 621. If this second period of time has elapsed, the process is continued with a step 622, in which the second source separation is reset. The resetting of the second source separation initiates the setting of the coefficient $W_2$ as a function of a $W_1^X$ (623). The $W_1^X$ correspond to first coefficient sets for different signal situations X. The module consequently reverts back to step 621 in a loop in order to await the second period of time again. According to this embodiment of the present invention, the second source separation is periodically reset once the second period of time has elapsed by the second coefficient set $W_2$ of the second source separation being reset as a function of a $W_1^X$.

Figure 6C:
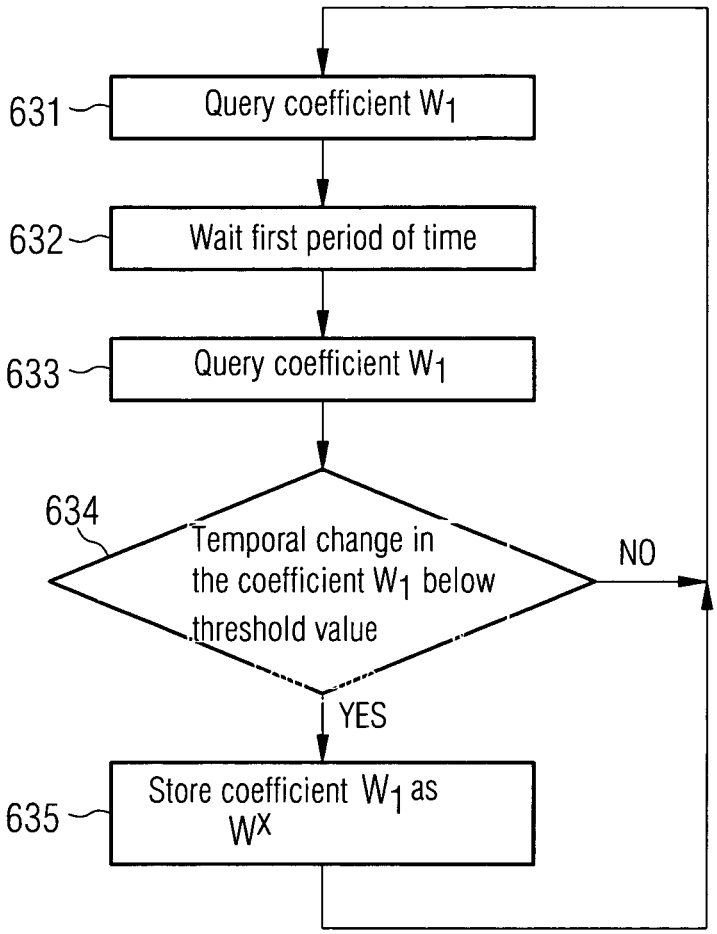

FIG. 6C shows a flow chart of a module according to a seventh embodiment of the present invention. The coefficients $W_1$ are firstly queried in a first step 631. The coefficients $W_1$ correspond to the first coefficient set. The first period of time is correspondingly awaited in a second step 632. A renewed querying of the coefficient set $W_1$ consequently follows in a second query step 633.

It is determined in a bifurcation 634 whether the temporal change in the first coefficient set $W_1$ within the first period of time is below a threshold value. This threshold value can correspond to a characteristic threshold value for instance, which delimits an adapted coefficient set $W_1$ from a non-adapted coefficient set $W_1$. If the temporal change in the first coefficient set $W_1$ lies below the threshold value, it is thus possible to determine for instance that the current coefficient set $W_1$ corresponds to a well adapted coefficient set for a special signal situation. Hereafter the corresponding first coefficient set $W_1$ can be stored in a following step 635 as a coefficient set for the corresponding signal situation. If the temporal change in the coefficient $W_1$ does not lie below the threshold value, the process is continued with a renewed querying of the coefficient $W_1$ (631).

The module according to this embodiment can also include buffering the coefficient set $W_1$ in step 631, in order to compare the buffered coefficient set $W_1$ with the coefficient set $W_1$ determined in step 633 and/or to determine a temporal change in the coefficient set. According to the seventh embodiment of the present invention, the module can also correspond to a setting of the coefficient sets in the group of storage units for corresponding signal situations.

Figure 6D:
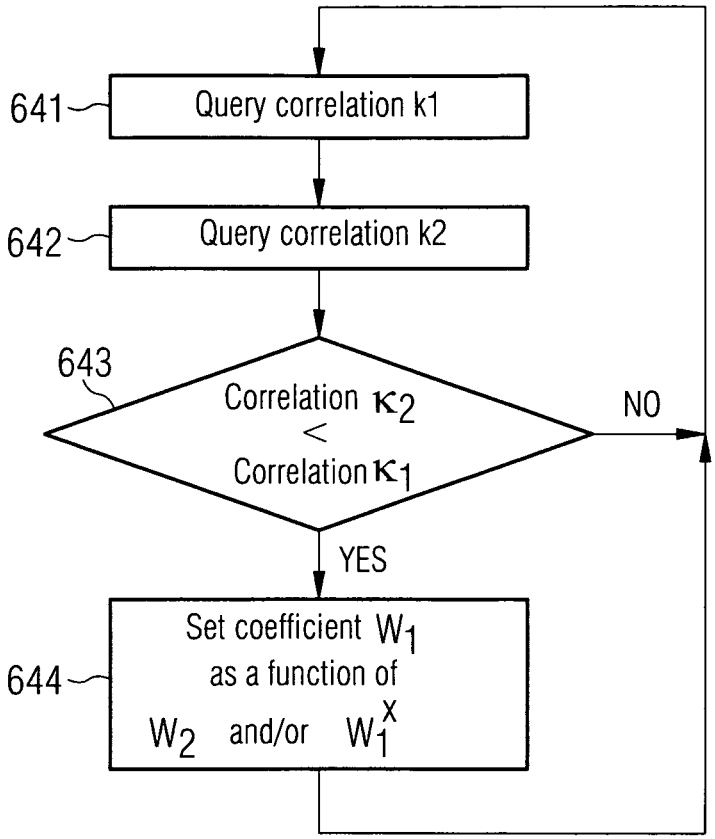

FIG. 6D shows a flow chart of a process according to an eighth embodiment of the present invention. In a first step 641, the first correlation $\kappa_1$ is queried. Consequently, the second correlation $\kappa_2$ is queried in a second step 642. In a bifurcation 443 which follows, the first correlation $\kappa_1$ is compared with the second correlation $\kappa_2$. If the second correlation $\kappa_2$ is smaller than the first correlation $\kappa_1$, the first coefficient set C is set in a following step 644 as a function of the second coefficient set $W_2$ and/or of a stored coefficient set $W_1^X$, according to a determined current signal situation X. If the number of coefficients of the second coefficient sets $W_2$ lies below the number of coefficients of the first coefficient sets $W_1$, one part or all coefficients of the second coefficient sets $W_2$ can firstly determine the corresponding coefficients of the first coefficient sets $W_1$. The remaining coefficients of the first coefficient sets $W_1$ can then be supplemented optionally according to a stored coefficient set $W_1^X$. As a result, a freezing of the first source separation is advantageously eliminated and the first source separation with a start coefficient set, which on the one hand is not frozen in a local minimum and on the other hand is optimally adapted, has start coefficients which correspond to the respective signal situation X.

However, if the second correlation $\kappa_2$ lies above the first correlation $\kappa_1$, a freezing of the first source separation is not determined. In this instance, the process is continued by querying the first correlation (641).

The modules, as described in conjunction with FIGS. 6A to 6D, can illustrate modules or processes which are implemented in the processing unit of an inventive hearing aid. Reference is made in particular here to FIG. 5, in which a corresponding processing unit 430 is shown, which shows a process unit for implementing several processes and/or modules (440 ff.).

The invention claimed is:

1. A method for processing at least two input signals in a hearing aid, with the input signals being dependent on an acoustic signal, the method comprising:

processing a plurality of input signals via a first source separation:

continuously determining a first correlation of a plurality of first output signals from the plurality of input signals and a first correlation coefficient set, wherein the first output signals comprise different, non-auto-correlated output signals wherein the first correlation is minimized and the first output signals are maximally separated, and continuously determining the first coefficient set as a function of the first correlation;

processing the plurality of input signals via a second source separation:

continuously determining a second correlation of a plurality of second output signals from the plurality of input signals and a second coefficient set, wherein the second output signals comprise different, non-auto-correlated output signals wherein the second correlation is minimized and the second output signals are maximally separated, and continuously determining the second coefficient set as a function of the second correlation;

comparing the first correlation with the second correlation;

changing the first coefficient set as a function of the second coefficient set when the second correlation is smaller than the first correlation; and changing the second coefficient set as a function of the first coefficient set when the second source separation is reset.

2. The method as claimed in claim 1, further comprising storing the first coefficient set.

3. The method as claimed in claim 2, wherein the first coefficient set is stored as a function of a temporal change in the first correlation.

4. The method as claimed in claim 2, wherein the first coefficient set is stored when the first correlation varies marginally within a first period of time, and wherein the first period of time lying in a range of 1 s to 10 s.

5. The method as claimed in claim 2, wherein the first coefficient set is stored in a storage unit of a storage unit group, and wherein the storage unit is selected as a function of a signal situation.

6. The method as claimed in claim 5, wherein the first coefficient set is changed as a function of a predetermined coefficient set, and wherein the predetermined coefficient set is recalled from a storage unit of the storage unit group as a function of the signal situation.

7. The method as claimed in claim 5, wherein a plurality of first coefficient sets are stored for a signal situation in storage units of the storage unit group, wherein a plurality of predetermined coefficient sets are recalled from the storage units as a function of the signal situation, wherein the first coefficient sets are changed as a function of the predetermined coefficient set, and determining the predetermined coefficient set for which a change in the first coefficient set produces a minimum first correlation.

8. The method as claimed in claim 1, wherein the second source separation is reset once a second period of time has elapsed.

9. The method as claimed in claim 5, wherein the second source separation is reset once a second period of time has elapsed, wherein the second coefficient set is changed during the reset process as a function of a predetermined coefficient set, and wherein the predetermined coefficient set is recalled from a storage unit of the storage unit group as a function of the signal situation.

10. The method as claimed in claim 5, wherein the second source separation is reset once a second period of time has elapsed, wherein a plurality of coefficient sets for a signal situation are stored in storage units of the storage unit group, wherein a plurality of predetermined coefficient sets are recalled from the storage units as a function of the signal situation, wherein the second coefficient set is changed during the reset process as a function of the predetermined coefficient sets, and determining the predetermined coefficient set for which a change in the second coefficient set produces a minimal second correlation.

11. The method as claimed in claim 5, further comprises determining at least one classification variable selected from the group consisting of:

a level of an input signal, a level of an output signal, a distribution of the level, a performance spectrum;

a spatial position of a source of one of the input signals, wherein the signal situation is determined as a function of the at least one determined classification variable.

12. The method as claimed in claim 1, further comprises:

processing the plurality of input signals via a third source separation:

continuously determining a third correlation of a plurality of third output signals from the two input signals and a third coefficient set, and continuously determining the third coefficient set as a function of the third correlation;

comparing the first correlation with the third correlation; and changing the first coefficient set when the third correlation is smaller than the first correlation.

13. The method as claimed in claim 12, wherein the first coefficient set is changed as a function of the third coefficient set.

14. The method as claimed in claim 12, wherein the third source separation is reset once a third period of time has elapsed and the third coefficient set being set to an output coefficient set during the reset process.

15. An apparatus for processing two input signals which are dependent on an acoustic signal in a hearing aid, with the apparatus comprising:

a processing unit configured to continuously determine two first output signals and including a first correlation module configured to determine a first correlation of the two first output signals from the two input signals with a first coefficient set and further configured to continuously determine the first coefficient set as a function of the first correlation, the processing unit further configured to continuously determine two second output signals and including a second correlation module to determine a second correlation of the two second output signals from the two input signals with a second coefficient set and further configured to continuously determine the second coefficient set as a function of the second correlation, with the processing unit configured to change the first coefficient set as a function of the second coefficient set, when the second correlation is smaller than the first correlation, and with the processing unit configured to reset the second coefficient set as a function of the first coefficient set, wherein the first output signals and the second output signal comprise different, non-autocorrelated output signals.

16. The apparatus as claimed in claim 15, wherein the processing unit comprises a storage unit, and wherein the processing unit stores the first coefficient set in the storage unit.

17. The apparatus as claimed in claim 16, wherein the processing unit stores the first coefficient set as a function of a temporal change in the first correlation.

18. The apparatus as claimed in claim 16, wherein the processing unit stores the first coefficient set when the first correlation varies marginally within a first period of time only, and wherein the first period of time lying in a range of 1 s to 10 s.

19. The apparatus as claimed in one of claims 15, wherein the processing unit comprises a storage unit group, and wherein the processing unit selects a storage unit from the storage unit group as a function of a signal situation and stores the first coefficient set in the selected storage unit.

20. The apparatus as claimed in claim 19, wherein the processing unit selects a storage unit from the storage unit group as a function of a signal situation and changes the first coefficient set as a function of the coefficient set stored in the selected storage unit.

* * * * *